US008360039B2

(12) United States Patent
Skinner et al.

(10) Patent No.: US 8,360,039 B2
(45) Date of Patent: Jan. 29, 2013

(54) IGNITION COIL

(75) Inventors: Albert Anthony Skinner, El Paso, TX (US); Harry Oliver Levers, Jr., El Paso, TX (US); Mark Albert Paul, El Paso, TX (US); Colin Hamer, Noblesville, IN (US); Hector J. Herrera, Chihuahua (MX)

(73) Assignee: Delphi Technologies, Inc., Troy, MI (US)

( * ) Notice: Subject to any disclaimer, the term of this patent is extended or adjusted under 35 U.S.C. 154(b) by 403 days.

(21) Appl. No.: 12/825,680

(22) Filed: Jun. 29, 2010

(65) Prior Publication Data

US 2011/0000472 A1 Jan. 6, 2011

Related U.S. Application Data

(60) Provisional application No. 61/222,581, filed on Jul. 2, 2009.

(51) Int. Cl.
*H01F 38/12* (2006.01)

(52) U.S. Cl. ..... 123/634; 336/90; 336/92

(58) Field of Classification Search ..... 123/634; 336/90, 92

See application file for complete search history.

(56) References Cited

U.S. PATENT DOCUMENTS

| | | | | | |
|---|---|---|---|---|---|
| 1,339,100 | A * | 5/1920 | Cavanagh | ..... | 361/270 |
| 1,641,364 | A * | 9/1927 | Wilson | ..... | 336/211 |
| 4,737,755 | A * | 4/1988 | Hopmans | ..... | 336/178 |
| 4,986,233 | A * | 1/1991 | Akagi et al. | ..... | 123/634 |
| 5,015,982 | A * | 5/1991 | Skinner et al. | ..... | 336/69 |
| 5,285,760 | A * | 2/1994 | Takaishi et al. | ..... | 123/634 |
| 5,359,313 | A | 10/1994 | Watanabe et al. | | |
| 5,923,236 | A | 7/1999 | Rapoport et al. | | |
| 6,294,974 | B1 | 9/2001 | Fukumoto | | |
| 6,433,663 | B1 * | 8/2002 | Fitzgerald et al. | ..... | 336/178 |
| 6,556,118 | B1 * | 4/2003 | Skinner | ..... | 336/182 |
| 6,679,236 | B2 * | 1/2004 | Skinner et al. | ..... | 123/634 |
| 7,049,923 | B2 * | 5/2006 | Skinner et al. | ..... | 336/90 |
| 2005/0241627 | A1 * | 11/2005 | Ward | ..... | 123/634 |

OTHER PUBLICATIONS

International Search Report dated Sep. 1, 2010.

* cited by examiner

*Primary Examiner* — Erick Solis
(74) *Attorney, Agent, or Firm* — James M. Chan

(57) ABSTRACT

An ignition apparatus includes a core, primary and secondary windings and a loop-shaped magnetic return path structure. The structure includes layers of wound strip steel or wound ferritic wire stacked in an outward fashion. The core is placed in an interior of the loop forming at least one air gap between a core end surfaces and the structure. A combined core and magnetic return path structure includes a continuous loop formed by winding ferritic wire either on a spool or on a mandrel and is then bonded. The bonded winding is cut to form two C-shaped portions. Each C-shaped portion has a central yoke that extends into a pair of parallel legs. The C-shaped portions are re-assembled over primary and second windings so that the legs form a pair of parallel branches. One branch acts as the core and the other branch acts as the magnetic return path.

13 Claims, 7 Drawing Sheets

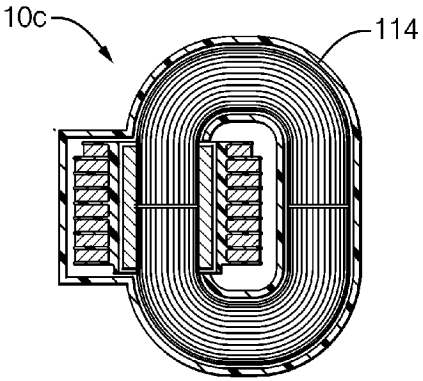
FIG. 13
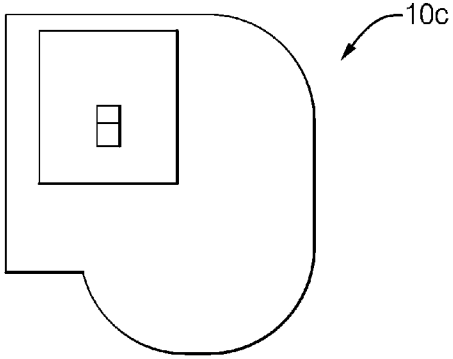
FIG. 14
FIG. 15
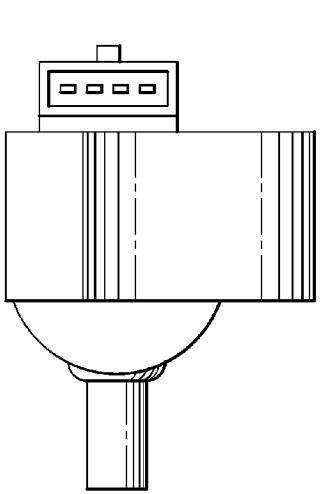
FIG. 16
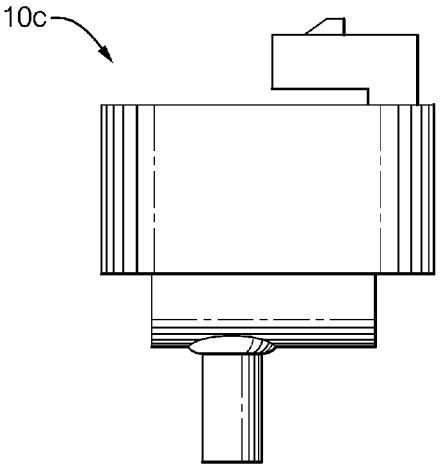
FIG. 17

IGNITION COIL

CROSS REFERENCE TO RELATED APPLICATIONS

This application claims the benefit of U.S. Provisional Patent Application Ser. No. 61/222,581 for an IGNITION COIL, filed on Jul. 2, 2009, which is hereby incorporated by reference in its entirety. This claim is made under 35 U.S.C. §119(e); 37 C.F.R. §1.78; and 65 Fed. Reg. 50093.

INCORPORATION BY REFERENCE

U.S. patent application Ser. No. 12/325,581 filed Dec. 1, 2008 entitled IGNITION COIL WITH CYLINDRICAL CORE AND LAMINATED RETURN PATH is hereby incorporated by reference in its entirety.

TECHNICAL FIELD

The present invention relates generally to an ignition apparatus or coil, and, more particularly, to an ignition apparatus that uses less copper wire and/or produces less scrap during manufacture than conventional arrangements.

BACKGROUND OF THE INVENTION

There has been much investigation in the development of an ignition apparatus for producing a spark for ignition of an internal combustion engine. As a result, the art has developed a variety of different configurations suited for many different applications. In general, it is known to provide an ignition apparatus that utilizes a high-voltage transformer that includes a magnetically-permeable core and primary and secondary windings. It is typical to use copper wire for the primary and secondary windings.

While there has always been an incentive to reduce the amount of copper wire in an ignition coil (and hence the cost attributable to copper), in recent times, the price of copper has increased over 400%, with the result that the cost of the copper wire in an ignition coil has become a significant portion of the total bill of materials (BOM). A couple of approaches are known in the art that have an effect on the amount of copper wire used in an ignition coil. One approach is to wind the primary winding directly onto a round magnetic core and thus eliminate a primary spool, which reduces the diameter of the primary winding turns, and thus the mean length per turn (MLT). For a comparable number of turns, this approach reduces the amount of copper wire. This approach also reduces the MLT of the secondary winding for the same reason, thereby also reducing the amount of copper wire attributable to the secondary winding. For the first approach, the magnetic core is circular in shape and is typically used with an open magnetic path configuration (i.e., a magnetic circuit with large air gaps).

Another approach is to provide a magnetic core that is rectangular in cross-section, and that is provided generally in a two-piece configuration with either a "C-I" or "E-I" shape. In this second approach, an air gap is provided, but is generally very tightly controlled resulting in a structure with a high magnetic permeability. The rectangular cross-section used in this second approach requires a primary spool for the primary winding and therefore increases the MLT of both the primary and secondary windings. However, the relatively high magnetic permeability of the core structure allows for a reduced number of turns as compared to the first approach. For example, U.S. Pat. No. 6,679,236 entitled "IGNITION SYSTEM HAVING A HIGH RESISTIVITY CORE" issued to Skinner et al. is illustrative of the first approach and discloses a round core with the primary winding wound directly onto the outer surface of the core. As a further example, U.S. Pat. No. 5,285,760 entitled "IGNITION COIL DEVICE FOR AN INTERNAL COMBUSTION ENGINE" issued to Takaishi et al. disclose a C-shaped laminated steel core, illustrative of the second approach described above. Co-pending U.S. patent application Ser. No. 12/325,581 filed Dec. 1, 2008 entitled "IGNITION COIL WITH CYLINDRICAL CORE AND LAMINATED RETURN PATH" addresses some of the problems noted above; however, a C-shaped return path disclosed therein is a stamped part in which scrap is formed during manufacture, and which process itself involves increased cost tooling.

Accordingly, there continues to be a need for an ignition coil that uses a reduced amount of copper wire and/or involves producing less scrap or eliminating costly tooling.

SUMMARY OF THE INVENTION

One advantage of the present invention is that it reduces the amount of copper wire used as compared to conventional ignition coils for comparable performance. Another advantage is that it reduces the amount of scrap produced during manufacture thereof. Still another advantage is that eliminates costly tooling to make the magnetic return path structure. Embodiments of the present invention achieve these advantages by providing a magnetic return path that eliminates scrap, can be made without costly tooling and which also permits the use of a circular-shaped magnetic core (i.e., where the primary winding can be wound directly around the core to reduce the MLT).

In one embodiment, an ignition apparatus includes a magnetically-permeable core, a primary winding, a secondary winding and a loop-shaped magnetically-permeable structure defining a high permeance magnetic return path. The core extends along an axis and has a pair of end surfaces on axially-opposite ends thereof. The core may preferably be circular to reduce the mean length per turn (MLT); however, other embodiments may be square or rectangular. The loop-shaped magnetic return path structure includes a plurality of layers of material (e.g., magnetically-permeable strip steel or ferritic wire in two preferred embodiments) stacked outwardly from its interior. The core is disposed in the interior of the loop-shaped structure so that the end surfaces of the core face opposing sides of the loop, and where at least one of the end surfaces is spaced apart from the loop to define an air gap.

In the strip steel embodiment, a length of strip steel is wound to form the plurality of layers that define the magnetic return path structure described above. The strip steel has width that corresponds to the width of the structure so no trimming, stamping or the like is involved and thus there is no scrap. In the wire embodiment, the ferritic wire may be black annealed iron wire, which is wound on a mandrel or the like into the desired loop-shape and then bonded. Again, the forming process does not produce any scrap.

In a still further embodiment, a combined core and magnetic return path structure is provided. In an initial production stage, a continuous loop-shaped structure is formed by winding ferritic wire either on a spool (in one variation) or on a mandrel (in another variation). Once formed, the initial structure is cut approximately in half to form two C-shaped portions. Each C-shaped portion has a respective central yoke (i.e., base) that extends into a pair of parallel legs. The C-shaped portions are re-assembled with respect to each other so that the legs form a pair of parallel branches. One branch acts as the core and around which is assembled the primary and secondary windings. The other branch defines the magnetic return path. Preferably, both branches include an air gap, for example, in the locations where the initial cuts occurred. Through the foregoing, an all-wire core and return path ignition apparatus is provided, which reduces use of copper, production of scrap as well as eliminating costly tooling.

Other aspects, features and advantages are also presented.

BRIEF DESCRIPTION OF THE DRAWINGS

The present invention will now be described by way of example, with reference to the accompanying drawings:

FIGS. 13-17 are various views of the embodiment of FIG. 12 incorporated into a case.

DETAILED DESCRIPTION OF THE PREFERRED EMBODIMENT

Figure 1:
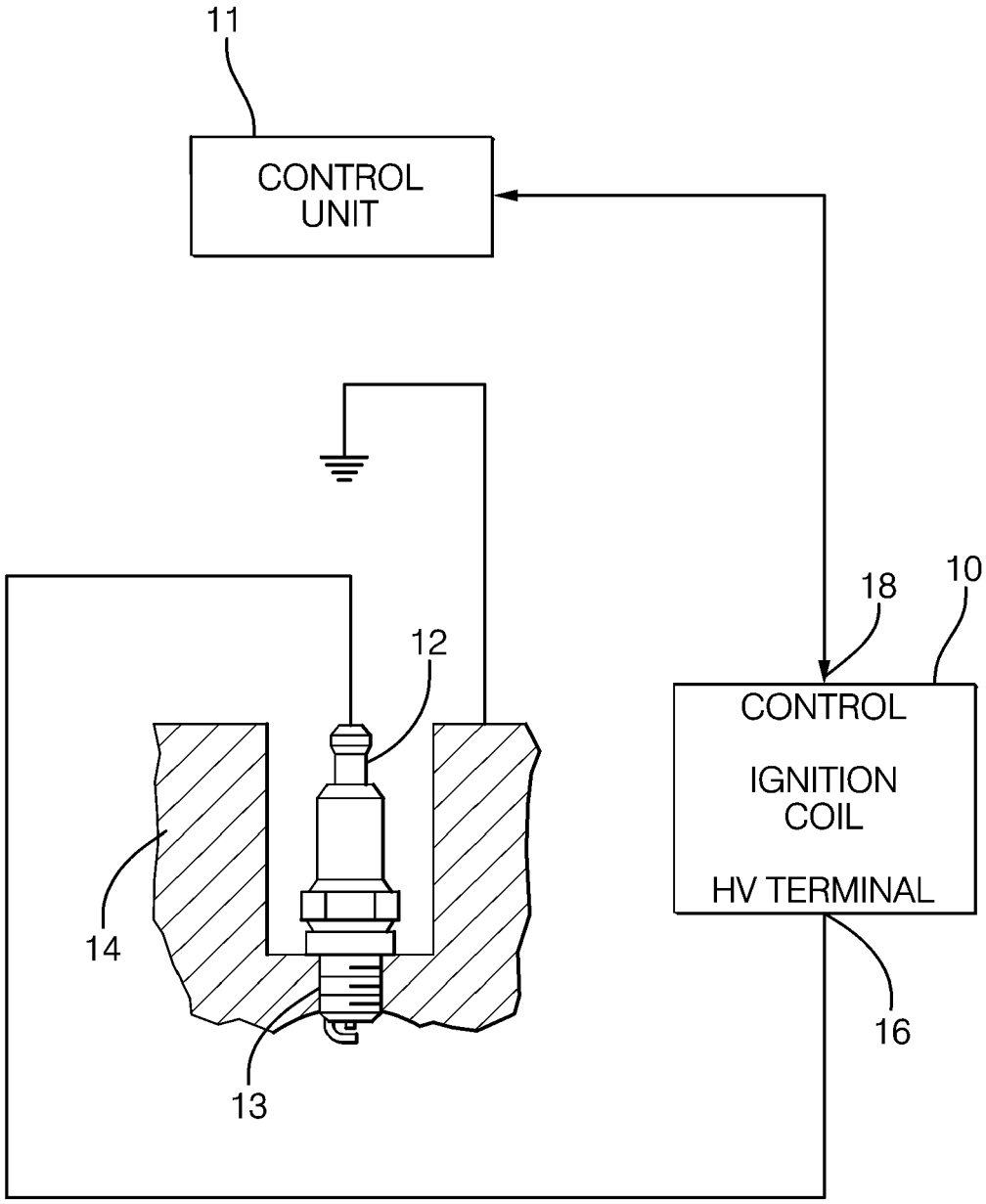
FIG. 1 is a diagrammatic and block diagram view of an ignition system in which embodiments of the invention may be used.

Referring now to the drawings wherein like reference numerals are used to identify identical components in the various views, FIG. 1 is a simplified diagrammatic and block diagram view of an ignition system, with portions shown in cross-section, in which embodiments of an ignition apparatus 10 may be used. The ignition apparatus 10 may be controlled by a control unit 11 or the like, as known. The ignition apparatus 10 is configured for connection to a spark plug 12 that may be in threaded engagement with a spark plug opening 13 leading to a combustion cylinder of an internal combustion engine 14. The ignition apparatus 10 is configured to output a high-voltage (HV) output (e.g., on a high-voltage terminal 16) which is provided to the spark plug 12. Generally, overall spark timing (dwell control) and the like may be controlled by the control unit 11, which may be communicated as a control signal that is applied to a control terminal 18 of the ignition apparatus 10. In certain embodiments, one ignition apparatus 10 may be provided per spark plug 12.

Figure 2:
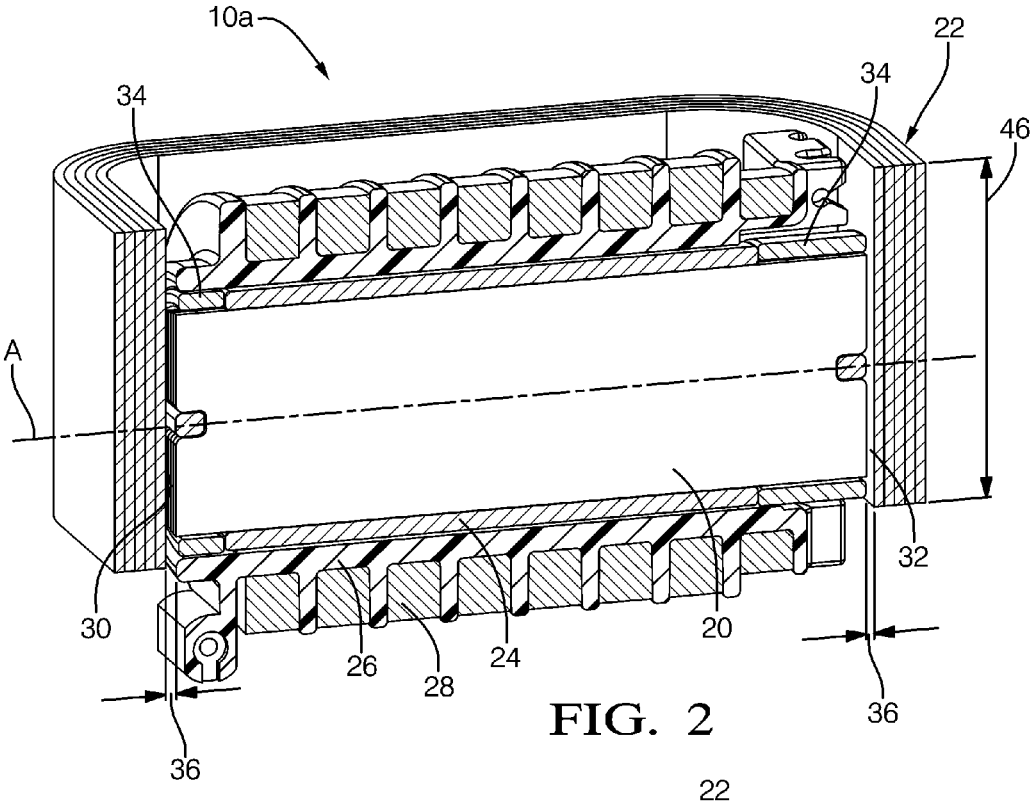
FIGS. 2-3 are isometric views of a first embodiment of an ignition apparatus having a magnetic return path structure formed of wrapped strip steel material.
Figure 3:
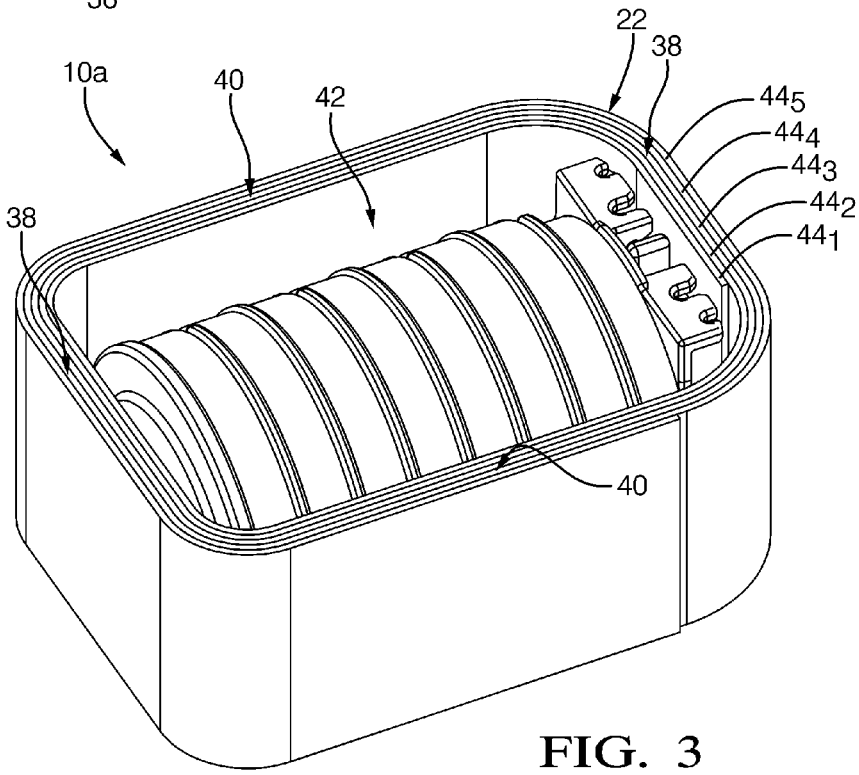

FIG. 2 is an isometric, cross-sectional view an ignition apparatus 10*a* (case omitted in FIGS. 2-3 for clarity). The ignition apparatus 10*a* uses a reduced amount of copper wire while at the same time having a magnetic return path that can be produced without any significant amount of scrap. In addition, no costly tooling is need to produce the return path structure. The ignition apparatus 10*a* may include a magnetically-permeable core 20, optional first and/or second magnets (not shown) at one or both ends of the core 20, a structure 22 configured to provide a high permeance magnetic return path, a primary winding 24, a secondary winding spool 26, and a secondary winding 28.

The core 20 extends generally along a longitudinal axis "A", is generally cylindrical in overall shape in the illustrated embodiment and includes a pair of end surfaces 30 and 32 at axially-opposite ends. The core 20 may comprise conventionally-used materials and construction approaches.

The core 20, in one variation, may comprise a plurality of silicon steel laminations, arranged so as to generally form a cylindrical shape core (i.e., circular in radial cross-section). The use of steel lamination for magnetic cores in various ignition devices is known in the art and hence will not be described in any greater detail. For a core comprising steel laminations, a layer of tape, a shrink tube or other coating of electrical-insulating material is used to protect the primary winding 24 from the sharp edges of the laminations. In such an embodiment, the primary winding 24 may be wound on the outer surface thereof. A circular shape in radial cross-section, if used, allows for a reduction in the mean length per turn (MLT) of both the primary winding 24 and the secondary winding 28, as described generally in the Background. However, it should be understood that other variations are possible, for example, the general shape of the core formed by the laminations may be square or rectangular.

In a further variation, the core 20 may comprise insulated iron particles compression molded into a desired shape ("composite iron core"), for example, a generally cylindrical shape (i.e., circular in radial cross-section). The use of compressed insulated iron particles for magnetic cores in various ignition devices is known in the art and hence will not be described in any greater detail. In composite iron core embodiments, optional pole pieces 34, shown incorporated at the axial ends of the core 20, may be included to increase an area of an air gap 36 between the core end surfaces and the magnetic path return structure 22. The air gap 36 may be distributed entirely at one axial end, or alternatively may be split (e.g., equally) between the two axial ends of the core 20.

Regardless of the core type, the ignition apparatus 10*a* may optionally use magnets (not shown) at one or both of the ends of the core 20. Such magnets, if used as part of the magnetic circuit, may provide a magnetic bias for improved performance. The construction of such magnets (if included), as well as their use and effect on performance, is understood by those of ordinary skill in the art. It should be understood that round magnets, in general, are less expensive to manufacture than rectangular magnets, and if used at one or both ends of the core 20, would allow for a reduced size core. As a result, using such magnets would provide an even further reduction in the amount of copper wire.

FIG. 3 is an isometric view showing the magnetic return path structure 22. In the illustrated embodiment, the structure 22 is a loop-shaped structure taking the shape of a rectangle, although it should be understood this shape is exemplary only and not limiting in nature. The structure 22 includes a pair of first sides 38 (e.g., shorter in length) extending into a pair of second sides 40 (e.g., longer in length) which sides collectively define an interior 42. The core 20 is disposed in the interior 42 such that the end surfaces face a respective one of the first sides 38. At least one of the end surfaces is spaced apart from one of the first sides of the loop to define one or more air gaps 36. The typical range for an air gap may be between about 0.5 to 2 mm. To maximize energy stored, the gap should be large enough to keep the core from saturating to the normal operating current, or level of ampere-turns (primary current×primary turns). This construction lowers the overall number of turns of the primary winding needed to achieve performance comparable to that of an "open" magnetic circuit configuration.

In accordance with the invention, the magnetic return path structure 22 comprises a plurality of layers (e.g., see layers $\mathbf{44}_1$, $\mathbf{44}_2$, $\mathbf{44}_3$, $\mathbf{44}_4$, $\mathbf{44}_5$ in FIG. 3) stacked outwardly from the interior 42, and preferably comprises a continuous wrap of magnetically-permeable material. In one embodiment, the structure 22 is formed using strip steel having a width 46 (see FIG. 2), which is the same as the desired width of the return path structure 22. A length of the strip steel is then wound around a fixture or spool to form the final return structure 22. The strip steel material may be non grain oriented electrical steel (e.g., 50A800 as per JIS C 2552 standard), grain oriented electrical steel or an any ferritic material as long as there is at least a sufficient (i.e., minimum predetermined value) interlayer resistance. The interlayer resistance may be provided by an oxidized surface of the steel material or through the use of a known electrically-insulative coatings. Moreover, various core plate are available in electrical steel variations.

Referring now to FIGS. 2-3 for a description of the remaining components, the primary winding 24 may be wound directly onto the core 20 in a manner known in the art. The primary winding 24 includes first and second ends that are connected to primary terminals (not shown), and is configured to carry a primary current $I_P$ for charging the ignition apparatus 10*a* upon control of the ignition control unit 11 (as known). The primary winding 24 may comprise copper, insulated magnet wire, with a size typically between about 20-23 AWG. The primary winding 24 may be implemented using known approaches and conventional materials.

The secondary winding spool 26 is configured to receive and retain the secondary winding 28. The spool 26 is disposed adjacent to and radially outwardly of the core 20 and the primary winding 24 and may be in coaxial relationship therewith. The spool 26 may comprise any one of a number of conventional, known spool configurations. In the illustrated embodiment, the spool 26 is adapted for use with a segmented winding strategy (e.g., a spool of the type having a plurality of axially spaced ribs forming a plurality of channels therebetween for accepting windings). However, it should be understood that other known configuration may be adapted and employed, such as, for example only, a progressive winding approach (one continuous secondary winding surface). The spool 26 may be formed generally of electrical insulating material having properties suitable for use in a relatively high temperature environment. For example, the spool 26 may comprise plastic material such as PPO/PS (e.g., NORYL available from General Electric) or polybutylene terephthalate (PBT) thermoplastic polyester. It should be understood that there are a variety of alternative materials that may be used for the spool 26.

The secondary winding 28 includes a low voltage end and a high voltage (HV) end. The low voltage end may be connected to ground by way of a ground connection. The high voltage end is connected to a high-voltage (HV) terminal, such as a metal post or the like that may be formed in the secondary spool or elsewhere. An electrical connection may then be made between the HV terminal and a corresponding electrical termination formed in the case, for ultimate delivery of the spark voltage to the spark plug. The secondary winding 28 may be implemented using conventional, known approaches and material (e.g., copper, insulated magnet wire).

In sum, the embodiment of FIGS. 2-3 provide a magnetic return path structure that can not only be produced without scrap or use of costly tooling, but that also permits the use of a circular core, which reduces the amount of copper used.

Figure 4:
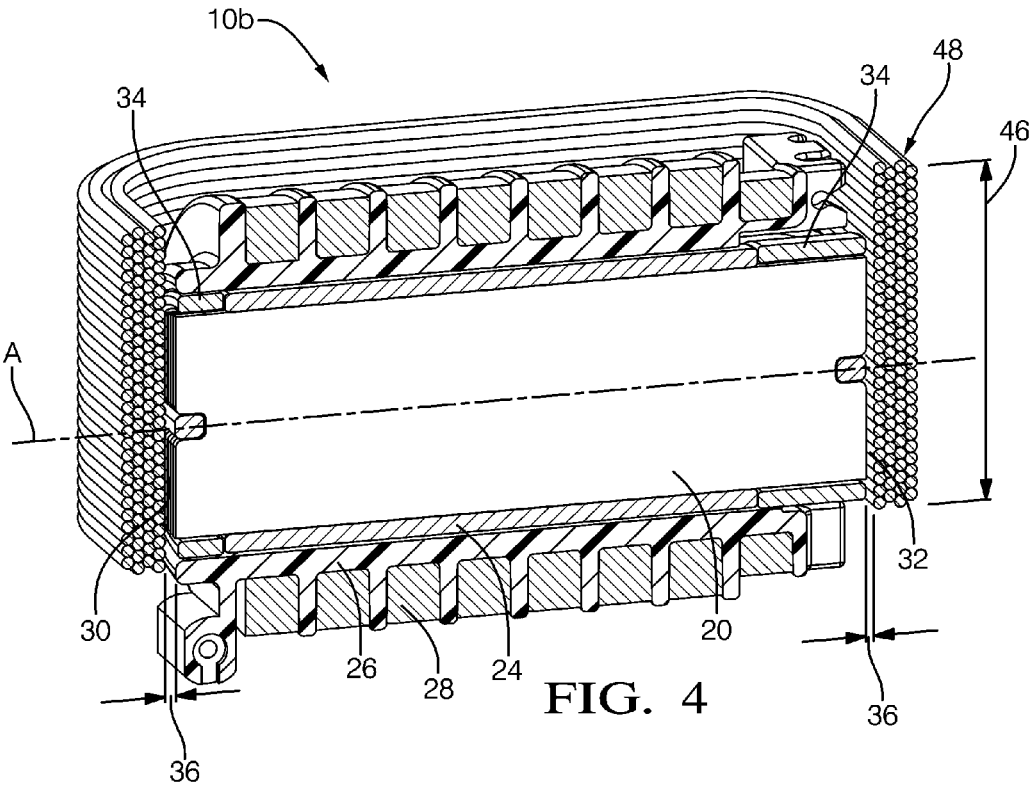
FIGS. 4-5 are isometric views of a second embodiment of an ignition apparatus having a magnetic return path structure formed of wrapped ferritic wire.
Figure 5:
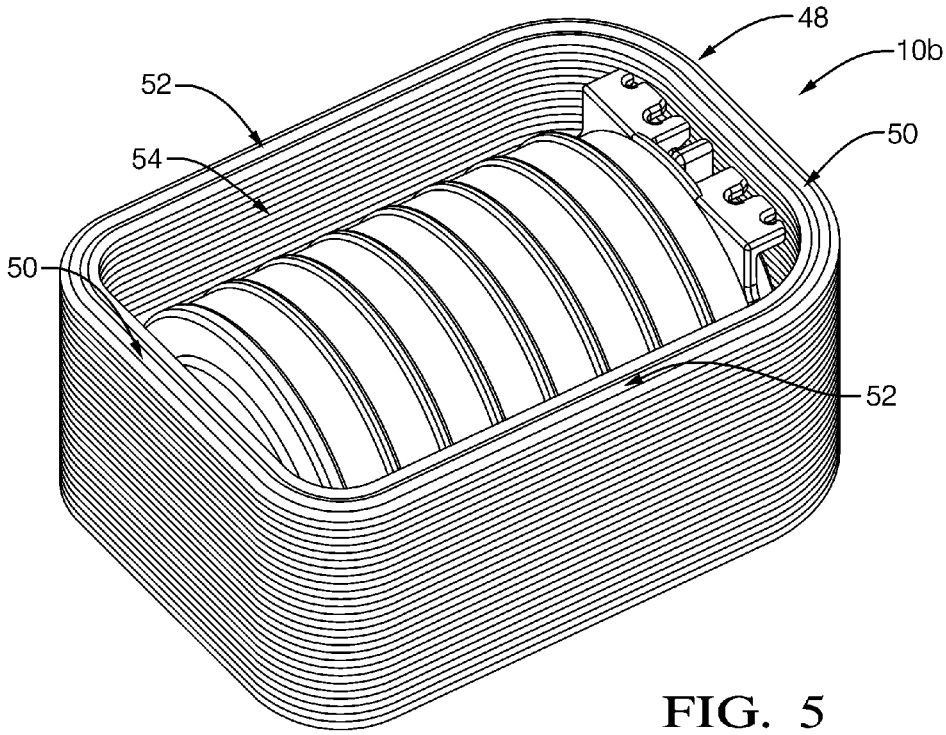

FIG. 4 is an isometric, cross-sectional view an ignition apparatus 10*b* (again, case omitted in FIGS. 4-5 for clarity). The ignition apparatus 10*b* uses a reduced amount of copper wire while at the same time incorporates a magnetic return path structure capable of being produced without any significant scrap and without a costly tool. The description of the ignition apparatus 10*a* made above applies in all regards to the ignition apparatus 10*b* with the following exception: the magnetic return path structure 22 made with strip steel is replaced by a similar magnetic return path structure 48 made with ferritic wire.

As shown in FIG. 5, the structure 48 is also a loop-shaped structure taking the shape of a rectangle, although it should be understood this shape is exemplary only and not limiting in nature. The structure 48 includes a pair of first sides 50 (e.g., shorter in length) extending into a pair of second sides 52 (e.g., longer in length) which sides collectively define an interior 54. The core 20 is disposed in the interior 54 such that the end surfaces face a respective one of the first sides 50. At least one of the core end surfaces is spaced apart from one of the first sides to define one or more air gaps 36. The magnetic return path structure 48 comprises ferritic wire that is wound so as to form a plurality of layers (e.g., layers $\mathbf{56}_1$, $\mathbf{56}_2$, $\mathbf{56}_3$, $\mathbf{56}_4$ as in FIG. 6) stacked outwardly from the interior 54, preferably as a continuous winding.

Figure 6:
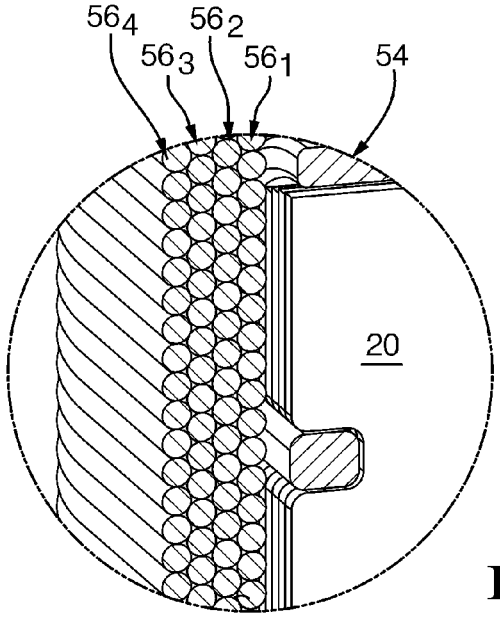
FIG. 6 is a partial cross-sectional view showing, in greater detail, the structure of FIG. 4.

FIG. 6 shows the layers $\mathbf{56}_1$, $\mathbf{56}_2$, $\mathbf{56}_3$, $\mathbf{56}_4$ formed by the wire in greater detail.

Referring now to FIGS. 4-6, the ferritic wire used to form the return path structure 48 may comprise black annealed iron wire. The cross-sectional shape of the wire may be round, square or rectangular. Note, in the case of a rectangular geometry wire where the width is enlarged so as to be the same as the strip in the embodiment of FIGS. 2-3, then this embodiment effectively merges with the embodiment of FIGS. 2-3. The diameter and/or geometry of the wire may be chosen to either reduce eddy current losses or increase them (i.e., by selecting a larger diameter). For example, increased eddy current losses may be desirable in some ion sense ignition systems in order to reduce the ringing that would otherwise occur after the spark is extinguished. Where the magnetic return path 48 needs to be electrically grounded, the iron wire embodiment has the additional benefit of allowing the start or end of the winding to be connected (e.g., welded) to the grounded lead-frame of the low voltage system connector (not shown).

Figure 7:
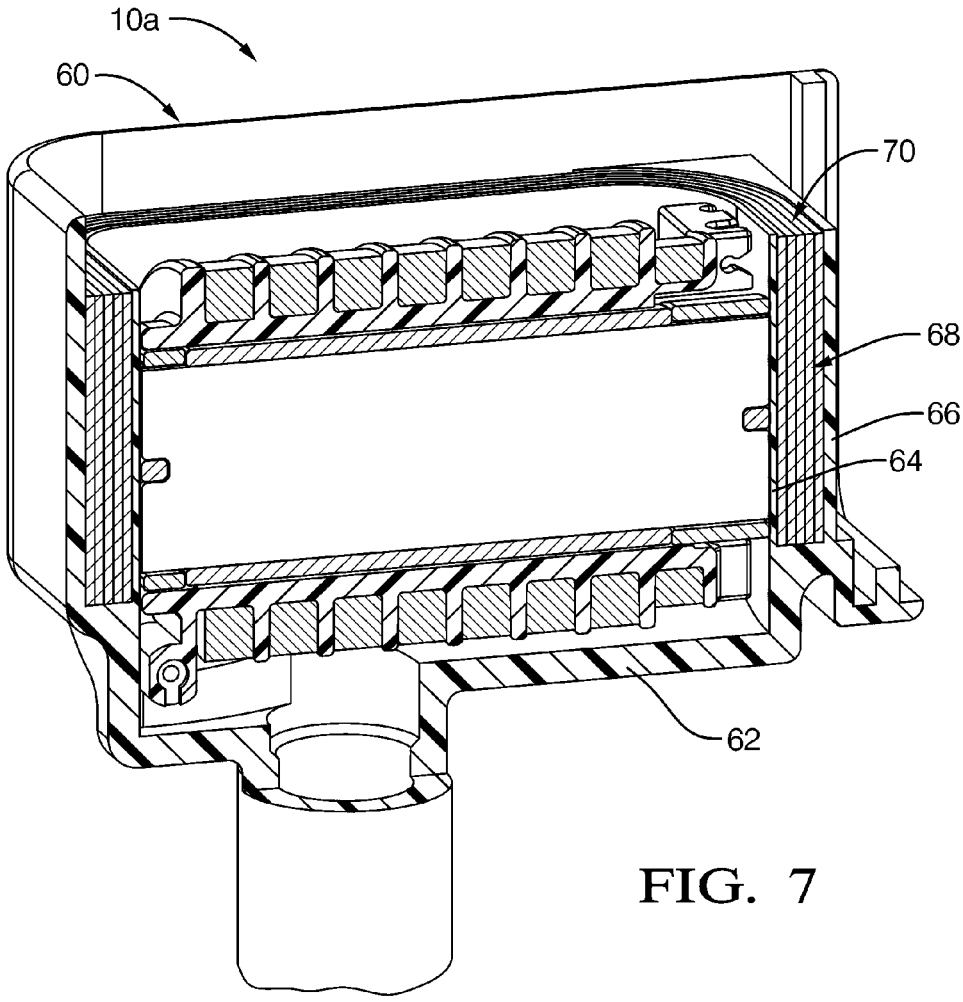
FIGS. 7-8 are isometric views showing the first embodiment of FIGS. 2-3 incorporated into a case.
Figure 8:
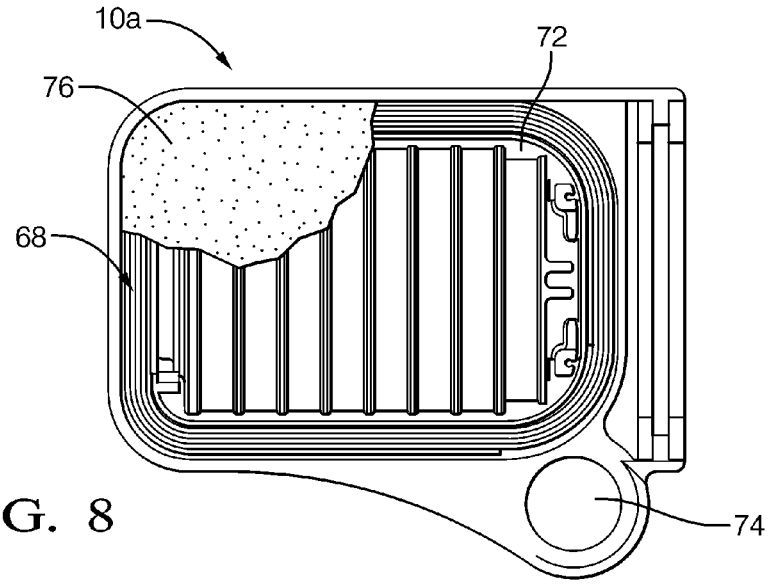

FIGS. 7-8 are cross-sectional and top views, respectively, of the ignition apparatus 10*a* (with the wrapped steel magnetic return path 22) disposed in a case 60. The case 60 is formed of electrical insulating material, and may comprise conventional, known materials (e.g., the PBT thermoplastic polyester material referred to above) and construction/configuration approaches. The case 60 includes a floor 62 from which extends a first generally circumferentially-extending inner sidewall 64 and a second generally circumferentially-extending outer sidewall 66 that is outwardly spaced from the inner sidewall 64 to form a generally loop-shaped, rectangular slot 68 having a top opening 70. The floor 62 in combination with the inner sidewall 64 form a case interior 72 that is accessed via an upper opening of the case 60.

The slot 68 is configured in size and shape to receive and retain the magnetic return path structure 22, which may be inserted therein via the top opening 70. Alternatively, the magnetic return path structure may be over-molded into the case. The slot 68 is further configured to isolate the magnetic return path structure 22 from an encapsulant 76 (described below) used to encapsulate the central components located in the case interior 72. The top opening 70 of the slot 68 may be covered with a room temperature vulcanizing (RTV) rubber type material (not shown) and cured prior to encapsulation of the central components. Alternatively, the top opening 70 may be capped with a molded seal (not shown) also to isolate the structure 22 (i.e., the laminations) and prevent cracks occurring off of the sharp edges.

The case interior 72 is configured in size and shape to accommodate the central components, namely the core 20, the primary winding 24, the secondary spool 26 and the secondary winding 28. In the illustrated embodiment, the thickness of the inner sidewall 64 defines the "air" gap 36. Since the case 60 is formed of non-magnetically-permeable material, the spacing 36 is effectively an "air" gap from a magnetic point of view.

The case 60 may also include a low voltage connector or the like having electrically-conductive terminals (not shown) of conventional configuration to allow (1) electrical connection to the primary winding 24 and (2) to permit external electrical connections from the ignition apparatus 10*a* to the control unit 11. It is through these external connections that the control unit 11, among other things, electrically connects the first and second ends of the primary winding 24 to an energization source to charge the ignition apparatus prior to spark. The case 60 may also includes a high voltage, electrically-conductive connector (not shown) or the like of conventional configuration to bridge the HV end of the secondary winding 28 to an external HV connector destined for the spark plug 12. If a separate mount configuration, a conventional HV cable (not shown) may be used to deliver the high voltage (spark voltage) produced from the ignition apparatus 10*a* to the spark plug 12. If a direct mount, the HV cable is omitted and the case itself includes hardware for direct connection to the top of the spark plug, as known. The case 60 may also include a mounting feature, such as fastener through-bore 74. The bore 74 may be used to secure the ignition apparatus 10*a* in an engine compartment of an automotive vehicle using conventional fasteners, for example.

An encapsulant 76 (partially shown in FIG. 8 covering the central components) may be introduced (e.g., poured) into the case interior 72 to encapsulate the central components. The encapsulant 76 provides protection from environmental factors which may be encountered during the service life of the ignition apparatus 10*a*. The encapsulant 76 may also provide electrical insulation within the ignition apparatus 10*a*. In a preferred embodiment, the encapsulant 76 may comprise an epoxy potting material. Sufficient epoxy potting material 76 is introduced in the ignition apparatus 10*a* to fill the case interior 72 up to a desired level. There are a number of suitable epoxy potting materials, filler additives (e.g., silica) and the like known in the art.

Although not shown, the magnetic return path structure 48 (i.e., wrapped wire return path structure) may be incorporated into a case similar to that just described about in connection with FIGS. 7-8, but without the need for the inner sidewall 64, which can be omitted.

In addition to eliminating scrap and costly tooling, the use of the wire-wrapped return path structure 48 has the added benefit of having reduced thermo-mechanical stress. First, use of a round wire yields no sharp edges on which to concentrate stress. Second, in certain embodiments, the epoxy material used as the encapsulant 76 may include a filler, for example, 40% to 60% filled with silica material. The silica material lowers the coefficient of thermal expansion (CTE) of the composite silica-epoxy mixture. The silica has a very low CTE (e.g., 0.5 to $10\times10^{-6}/°$ C. depending on whether the silica is crystalline or fused) while the CTE for steel may be around about $11\times10^{-6}/°$ C. Because the tight winding of the wires acts to filter out the silica filler, the encapsulant that fills in between the wires will essentially only be unfilled epoxy (i.e., unfilled with silica filler—just epoxy). The composite of the unfilled epoxy (i.e., unfilled with silica filler) and the steel (i.e., the wire itself) would yield a CTE in the range comparable to a 70% silica filled epoxy. While the composite CTE is still a little lower than for a standard fill (i.e., 40%-60%) epoxy blend, it is nonetheless much closer. Thus, in the direction along the axis of the wires, the CTE will be controlled by that of the wire, but across the bundle of wires defining the structure 48, the higher CTE of the unfilled epoxy will be expanding between the wires. Overall, in the thickness and high tension direction in the structure 48, the composite CTE will be very near that of the silica-epoxy mixture. It should be understood that variations of the foregoing are possible.

In still further embodiments, the configuration of using a low cost magnetic return path structure is extended so as to provide a low cost combined core and magnetic return path structure, which may use only ferritic wire as the magnetically-permeable material (i.e., so called "total wire and return path" embodiments). The combined core and return path are loop-shaped core structures, as shown particularly in FIGS. 9 and 10.

Figure 9:
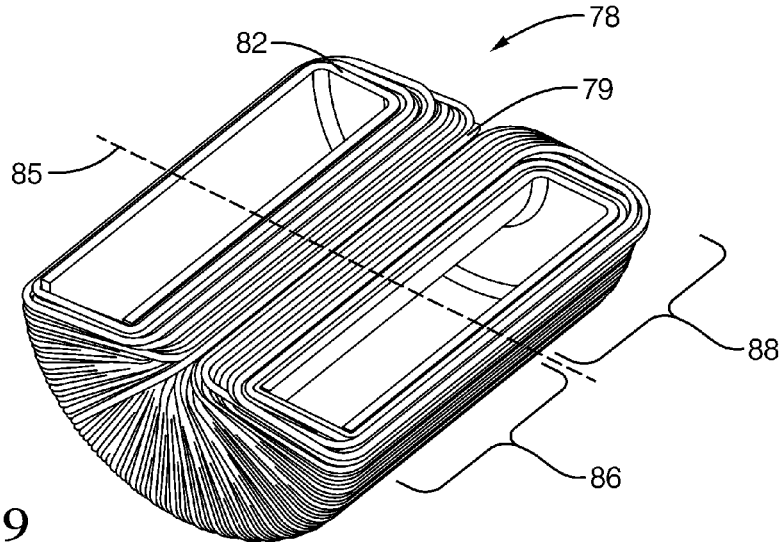
FIG. 9 is an isometric view showing a combined core and magnetic return path structure formed of ferritic wire wound on a spool.
Figure 10:
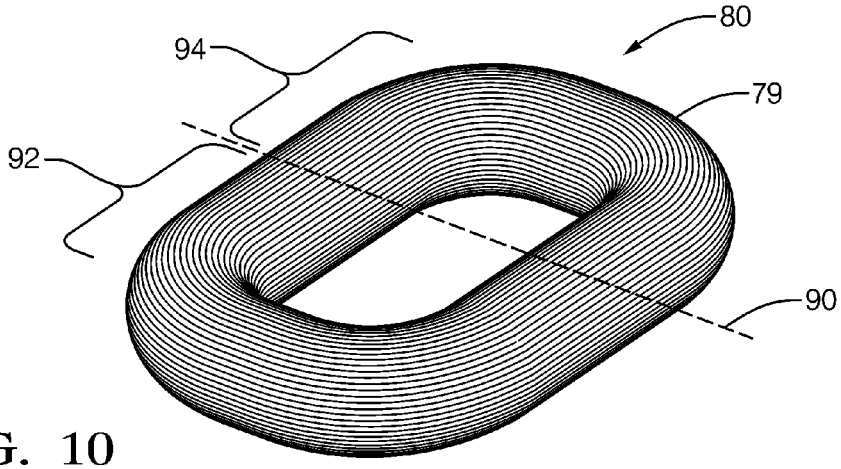
FIG. 10 is an isometric view showing a combined core and magnetic return path structure formed of a ferritic wire wound on a mandrel without the use of a spool.

In FIG. 9, an improved core and magnetic return path structure 78 is formed of ferritic wire 79, while in FIG. 10 an improved core and magnetic return path structure 80 is also formed of ferritic wire—wound on a mandrel without the use of a spool.

Figure 11:
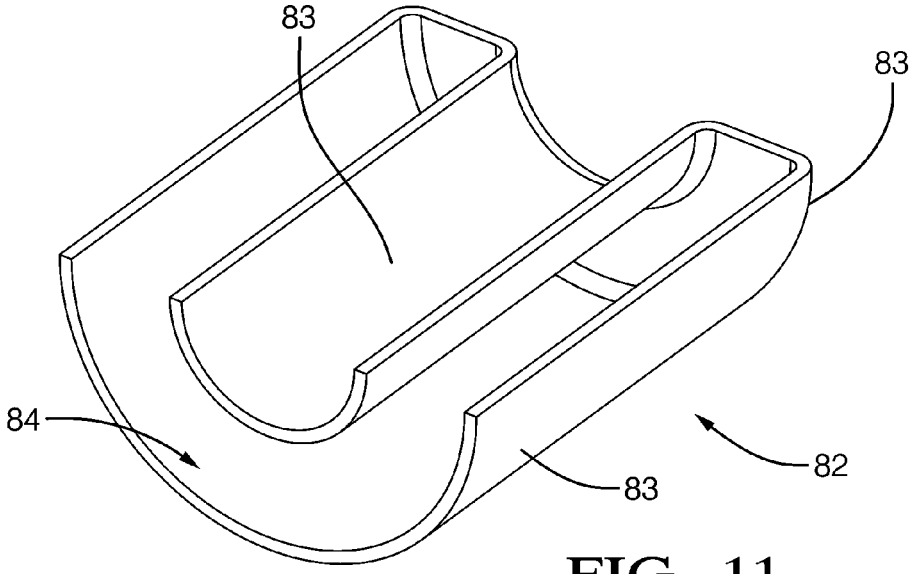
FIG. 11 is an isometric view showing, in greater detail, the spool in FIG. 9.

The core and return path structure 78 uses, in one embodiment, black annealed iron wire wrapped on a spool 82 (best shown in FIG. 11). The spool 82 is cup-shaped with a plurality of external winding surfaces 83 and an open top 84. The spool 82 is configured to be would with the ferritic wire using a fly winder, for example. The wound wire in the resulting wire-spool assembly is then bonded as a unit using epoxy or other suitable impregnating/bonding material (e.g., varnish, UV cure impregnating material) to form a composite structure. The composite structure is then cut generally in the direction along line 85 to form first and second C-shaped portions 86 and 88. An outer "leg" is fanned out to reduce the width of the package. The primary winding 24, the secondary winding spool 26 and the secondary winding 28 are then assembled over one of the two C-shaped portions 86, 88. The other one of the C-shaped portions 86, 88 is then assembled to the first C-shaped portion. The wire wound in the central part of the spool constitutes the central "core" (around which the primary/secondary windings are disposed) while the wire wound on the top/bottom and outer portions of the spool 82 constitute the magnetic return path. The assembly thus formed is then placed into a case for electrical termination. Encapsulant (e.g., epoxy potting material) is then poured into the case to encapsulate the central components.

Similarly, the core and return path structure 80 also uses, in one embodiment, black annealed iron wire 79, but is alternatively wrapped on a mandrel (not shown) or the like to form a loop-shaped winding. After winding, but while still retaining the loop shape, the wound wires are bonded together with epoxy or other suitable impregnating/bonding material (e.g., varnish, UV cure impregnating material) to form a bonded unit, as shown in FIG. 10. The resulting bonded unit is then cut, generally in the direction along line 90, to form first and second C-shaped portions 90 and 92.

Figure 12:
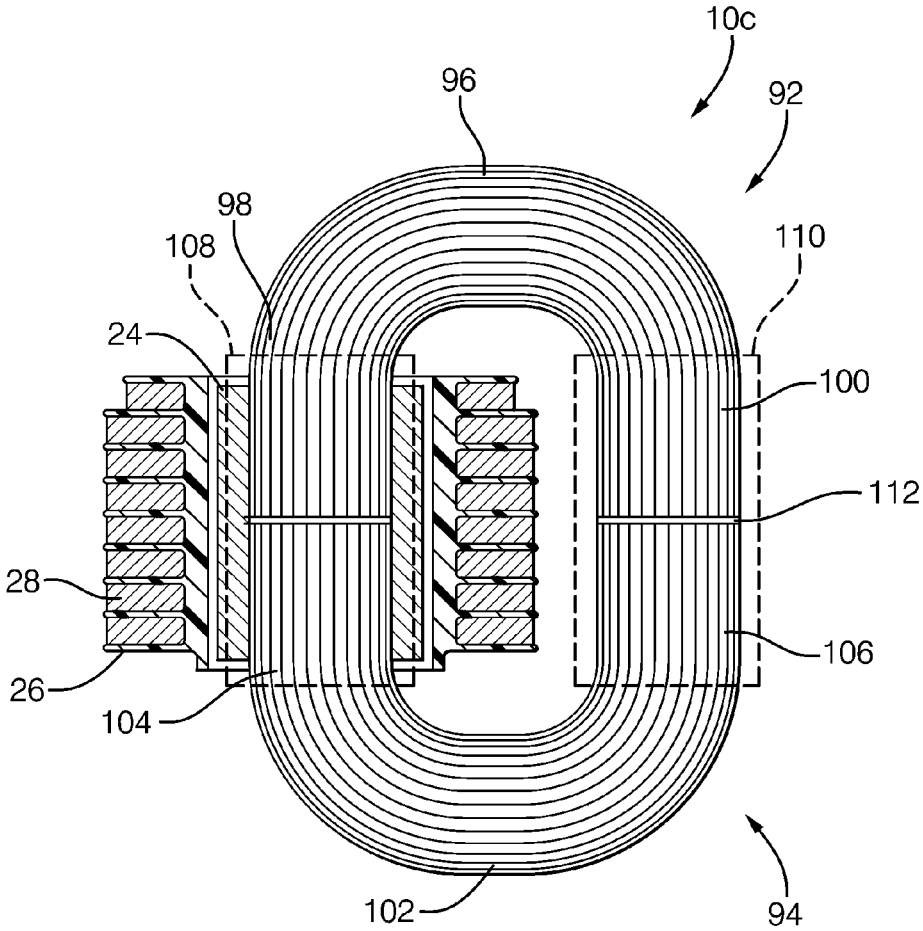
FIG. 12 is a side view of an embodiment incorporating the core and return path structure of FIG. 10.

FIG. 12 is a side view of an ignition apparatus 10*c* (case omitted for clarity). The description made above for the ignition apparatus 10*a*, 10*b* applies equally here with respect to the ignition apparatus 10*c*, except for the following: the ignition apparatus 10*c* incorporates the combined core and return path structure 80 rather than a separate core and return path. The magnetic return path structure 80 comprises first and second C-shaped portions 92, 94. The first C-shaped portion 92 includes a central yoke 96 from which extends a pair of legs 98, 100. Likewise, the second C-shaped portion 94 also includes a central yoke 102 from which extends a pair of legs 104, 106. The first and second C-shaped portions are reassembled over/through the primary winding 24, secondary spool 26 and secondary winding 28 so that corresponding legs of both C-shaped portions form first and second parallel magnetic branches 108, 110.

The first branch 108 acts as the core and around which are disposed the primary winding 24, the secondary spool 26 and the secondary winding 28. The second branch 110, on the other hand, forms a part of a magnetic return path (along with yokes 96 and 102). A location (location 112) where the original bonded unit was cut (i.e., cut line 90) defines the location for the "air" gap, which may be occupied by a non-magnetically permeable spacer, for example. The legs 98, 100, 104, 106 may be cut such that no gap or a only a small gap exists in the core branch 108 while a desired air gap at location 112 exists in the magnetic return path branch 110. Variations are possible, for example, distributing the air gap between the cut sites in both branches 108, 110, which is preferable since it reduces the number of machining steps (i.e., no additional cuts beyond those originally made to form the C-shaped portions).

FIGS. 13-17 are various views of the ignition apparatus 10*c* as incorporated into an external case 114. As shown, the case 114 corresponds to a so-called plug top case (PTC) mounting approach known generally in the art. The case 114 is configured in size and shape to form an interior suitable for receiving and retaining the assembly shown in FIG. 12. Once the assembly of FIG. 12 is disposed in the interior, encapsulant 76 may be introduced to encapsulate the central components, in a manner already described above.

FIG. 13 is a cross-sectional view of the ignition apparatus 10*c* of FIG. 12, taken through the case and the windings.

FIG. 14 is a is top view of the ignition apparatus 10*c*.

FIGS. 15-17 are various side views of the case 114 showing various features, including a potting surface 116, a level to which the encapsulant 76 is filled, a high voltage tower 118 suitable for direct connection to a spark plug, and a low-voltage (LV) connector assembly 120 configured for connection to the control unit 11 for receipt of a control signal (see FIG. 1) as well as power and ground signals.

While particular embodiments of the invention have been shown and described, numerous variations and alternate embodiments will occur to those skilled in the art. Accordingly, it is intended that the invention be limited only in terms of the appended claims.

The invention claimed is:

1. An ignition apparatus for an engine, comprising:

an magnetically-permeable core extending along an axis, said core having a pair of end surfaces on axially-opposite ends thereof;

a primary winding disposed outwardly of said core;

a secondary winding disposed outwardly of said primary winding;

a loop-shaped magnetic return path structure having an interior and a pair of opposing sides, wherein said core is disposed in said interior such that said end surfaces face said sides and at least one of said end surfaces is spaced apart from one of said sides to define an air gap;

wherein said structure comprises a plurality of layers stacked outwardly from said interior and comprising magnetically-permeable material.

2. The apparatus of claim 1 wherein said magnetically-permeable material comprises one of non-grain oriented electrical steel and grain oriented electrical steel.

3. The apparatus of claim 2 wherein adjacent layers exhibit a predetermined interlayer electrical resistance.

4. The apparatus of claim 2 wherein said magnetically-permeable material comprises ferritic wire.

5. The apparatus of claim 4 where said wire comprises black annealed iron wire.

6. The apparatus of claim 1 wherein said core comprises one of compressed insulated iron particles and laminated steel plates.

7. The apparatus of claim 6 further comprising at least one magnet disposed on one of the end surfaces of said core.

8. The apparatus of claim 1 further including a case comprising electrically-insulating material and configured to receive said core and said magnetic return path structure.

9. The apparatus of claim 8 wherein said case further includes a high-voltage connector coupled to receive a high voltage output produced at a high-voltage end of said secondary winding.

10. The apparatus of claim 8 wherein said case includes a floor, a first circumferentially-extending sidewall projecting from said floor, and a second circumferentially-extending sidewall projecting from said floor and spaced outwardly from said first sidewall to form a slot with an open top, said slot being configured to receive said magnetic return path structure, further comprising a seal to close said open top to thereby isolate said magnetic return path structure from encapsulate in said interior.

11. An ignition apparatus for an internal combustion engine, comprising:

a loop-shaped core having first and second C-shaped portions, each portion comprising ferritic wire, each portion having a respective central yoke from which extend a respective pair of legs, said C-shaped portions arranged so that said legs form a pair of parallel branches;

a primary winding disposed around one of said branches of said core;

a secondary winding disposed outwardly of said primary winding;

wherein another one of said parallel branches is free of said windings and defines a magnetic return path.

12. The apparatus of claim 1 further including a case comprising electrically-insulating material and configured to receive said core.

13. The apparatus of claim 12 wherein said case includes a high-voltage connector coupled to receive a high voltage output produced at a high-voltage end of said secondary winding.

* * * * *